US006033262A

United States Patent [19]

Heimueller et al.

[11] Patent Number: 6,033,262

[45] Date of Patent: Mar. 7, 2000

[54] CONTACT SPRING

[75] Inventors: Hans-Jost Heimueller, Dudenhofen; Martin Straeb, Diessen, both of Germany

[73] Assignee: Siemens Aktiengesellschaft, Munich, Germany

[21] Appl. No.: 08/904,000

[22] Filed: Jul. 31, 1997

[30] Foreign Application Priority Data

Jul. 31, 1996 [DE] Germany ..... 196 30 939

[51] Int. Cl.[7] ..... H01R 13/40

[52] U.S. Cl. ..... 439/595; 439/752.5

[58] Field of Search ..... 439/595, 745, 439/744, 278, 852, 597, 598, 599

[56] References Cited

U.S. PATENT DOCUMENTS

| | | | |
|---|---|---|---|
| 5,002,504 | 3/1991 | Carlson | 439/595 |
| 5,607,327 | 3/1997 | Tsuji et al. | 439/752 |
| 5,660,555 | 8/1997 | Ito et al. | 439/278 |
| 5,791,945 | 8/1998 | Myer et al. | 439/852 |

FOREIGN PATENT DOCUMENTS

| | | |
|---|---|---|
| 0 070 098 A2 | 1/1983 | European Pat. Off. . |
| 2 698 730 A1 | 6/1994 | France . |
| 4203379A1 | 8/1993 | Germany . |
| 4227287A1 | 2/1994 | Germany . |
| 4312549A1 | 3/1995 | Germany . |
| 195 13 582 A1 | 10/1996 | Germany . |
| 196 11 698 A1 | 10/1997 | Germany . |

OTHER PUBLICATIONS

German Utility Model G 88 10 033.2, dated Jan. 11, 1990.

German Utility Model G 92 02 365.7, dated Jul. 29, 1993.

*Primary Examiner*—Michael L. Gellner
*Assistant Examiner*—Antoine Ngandjui
*Attorney, Agent, or Firm*—Herbert L. Lerner; Laurence A. Greenberg; Werner H. Stemer

[57] ABSTRACT

The contact spring has a conventional base spring. A novel detent sleeve is mounted on the base spring. The detent sleeve projects beyond the base spring in the insertion direction and it is formed with a recess or a void in the projecting portion. A detent element inside the housing snaps into the void and locks the detent sleeve and the base spring in the housing.

11 Claims, 2 Drawing Sheets

CONTACT SPRING

BACKGROUND OF THE INVENTION

1. Field of the Invention

The invention relates to contact springs. More specifically, the invention pertains to a contact spring with a base spring which on one end has a connecting part for an electrical power cord and on the other has a contact part with at least two spring arms, and having a detent sleeve, seated on the base spring, as a detent-type aid in retaining the contact spring inside a surrounding housing.

2. Description of the Related Art

Contact springs of this kind are widely known are described for instance in German utility model DE-U 92 02 365. Such contact springs are used widely as plug connectors in the automotive field, among others. Typically, the contact spring comprises a base spring, from which two spring arms of a contact part extend integrally away on one end, and a contact pin can be inserted between the two spring arms. The other end of the base spring is adjoined by a connecting part for an electrical power cord.

By way of example, the connecting part can be a crimp connection with a conductor wire claw and an insulation claw, which are clamped onto an electrical power cord or its sheathing. In the contact spring described in the aforementioned reference, a detent sleeve, also called an overspring, is seated on the base spring. The function of the detent sleeve is essentially to increase the spring force of the contact spring, and by being embodied with one or more detent tongues, to enable a disconnectable locking of the contact spring in an associated contact chamber of a surrounding housing made of insulating material.

The detent sleeve as a rule comprises a material with good spring properties, while the base spring is made from a material with good electrical and thermal properties. The detent sleeve can for example be made from a sheet metal as a stamped and bent part. The base spring is preferably also a stamped and bent part, but because of the requisite good electrical properties it preferably comprises tin bronze or so-called spring bronze.

Plug connectors must often be dustproof and/or splashproof. To achieve such sealed-off plug connectors, it is possible to use so-called sealing plates, such as rubber plates. The contact springs must be passed through these sealing plates, which are disposed on the surrounding housing.

It has been found that the inserted sealing plates become damaged especially whenever the contact elements have to be passed through this sealing plate multiple times in both directions, as can be the case when the plug connector is repaired, for instance. The sealing plates do have openings through which the contact springs can be guided. However, to achieve adequate sealing, these openings are smaller in diameter than the contact springs, so that when the contact spring is pushed through these openings, the openings in the sealing plate necessarily widen and stretch.

However, the prior art contact springs are distinguished by sharp-edged elements, which injure the sealing plate especially when the contact spring is pulled out of the contact chamber. Examples of these sharp-edged elements are first the detent tongue, provided in the conventional contact springs, on the detent sleeve and, if present, a sharp-edged polarizing tab bent at right angles out of a side wall of the detent sleeve.

SUMMARY OF THE INVENTION

It is accordingly an object of the invention to provide a contact spring, which overcomes the above-mentioned disadvantages of the heretofore-known devices and methods of this general type and which is improved over the previously known contact springs and is maximally well suited for use in surrounding housings that are equipped with a sealing plate.

With the foregoing and other objects in view there is provided, in accordance with the invention, a contact spring, comprising:

a housing formed with a chamber and a detent element in the chamber;

a base spring disposed in the housing, the base spring being formed with a connecting part for an electrical power cord at a first end thereof and with a contact part at a second end thereof, the contact part having at least two spring arms defining an insertion direction of the contact spring;

a detent sleeve seated on the base spring for retaining the base spring inside the housing;

the detent sleeve having a projecting portion projecting past the spring arms in the insertion direction, the projecting portion of the detent sleeve being formed with a void for receiving the detent element of the housing.

In other words, the objects of the invention are satisfied in that the detent sleeve protrudes past the spring arms in the insertion direction and has a void, at least in the protruding region, into which void a detent element of the surrounding housing can snap into place.

In accordance with an added feature of the invention, the detent sleeve has a given width and the void extends over the entire given width. This allows a correspondingly wide embodiment of the detent element inside the surrounding housing, so that to undo the thus-effected primary locking, strong forces must be brought to bear. A contact spring inserted properly into a contact chamber of a surrounding housing can be pulled out unintentionally only if relatively major force is exerted.

In accordance with an additional feature of the invention, the detent sleeve is box-shaped, and including a polarizing tab formed on an outer wall of the detent sleeve.

In accordance with a further feature of the invention, the polarizing tab is formed without an edge in the insertion direction and opposite the insertion direction. This assures that when the contact spring is passed through a sealing plate, such as a rubber plate, no unintentional tearing open of the rubber plate occurs. The polarizing tabs can be made in a simple manner by pressing a tab out of the abovementioned wall of the detent sleeve using a suitable punch.

In accordance with an additional feature of the invention, the detent sleeve is formed with guard tabs on a front end thereof toward the insertion direction. The guard tabs are bent obliquely inward. In accordance with again an additional feature of the invention, the detent sleeve may also be formed with guard tabs on the front end which are bent backward by 180° opposite the insertion direction. The guard tabs may also be provided with an embossed feature. These provisions assure that when the contact spring is initially pushed through the aforementioned sealing plate, once again no sharp-edged elements that could damage the sealing plate are involved.

In accordance with again a further feature of the invention, the housing includes a springy or resilient wall part carrying the detent element on an end thereof such that, when the base spring and the detent sleeve are inserted into the contact chamber of the housing, the detent element catches in the void of the detent sleeve.

In accordance with yet an added feature of the invention, the housing includes a slide element formed with an edge which, when the base spring and the detent sleeve are properly inserted into the chamber of the housing, grips the detent sleeve from behind for secondarily locking the detent sleeve in the housing.

In accordance with yet an additional feature of the invention, the housing includes the above-mentioned sealing plate bounding the chamber, the base spring and the detent sleeve being passed through the sealing plate when the contact spring is assembled. The sealing plate is preferably disposed at an end of the housing distally from an insertion side thereof, and a plane of the sealing plate extends substantially orthogonally to the insertion direction.

In accordance with a concomitant feature of the invention, the sealing plate is a rubber plate formed with openings, the openings having a diameter smaller than a cross section diameter of the detent sleeve. The allows proper insertion of the base spring and the detent sleeve into the housing chamber and subsequent sealing of the interior contact chamber after insertion.

The invention is based essentially on the fact that in a contact spring having a base spring (described, for instance, in the earlier German patent applications P 196 11 698.8 or P 195 3 582.2), a novel detent sleeve that has no sharp-edged elements and in particular no detent tongue is mounted on it. Instead, the detent sleeve has a void that can be engaged on the inside by a corresponding detent element of a surrounding housing into which the contact spring is inserted. According to the invention, the void in the detent sleeve is disposed in a region that protrudes past the spring arms of the base spring.

Other features which are considered as characteristic for the invention are set forth in the appended claims.

Although the invention is illustrated and described herein as embodied in a contact spring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
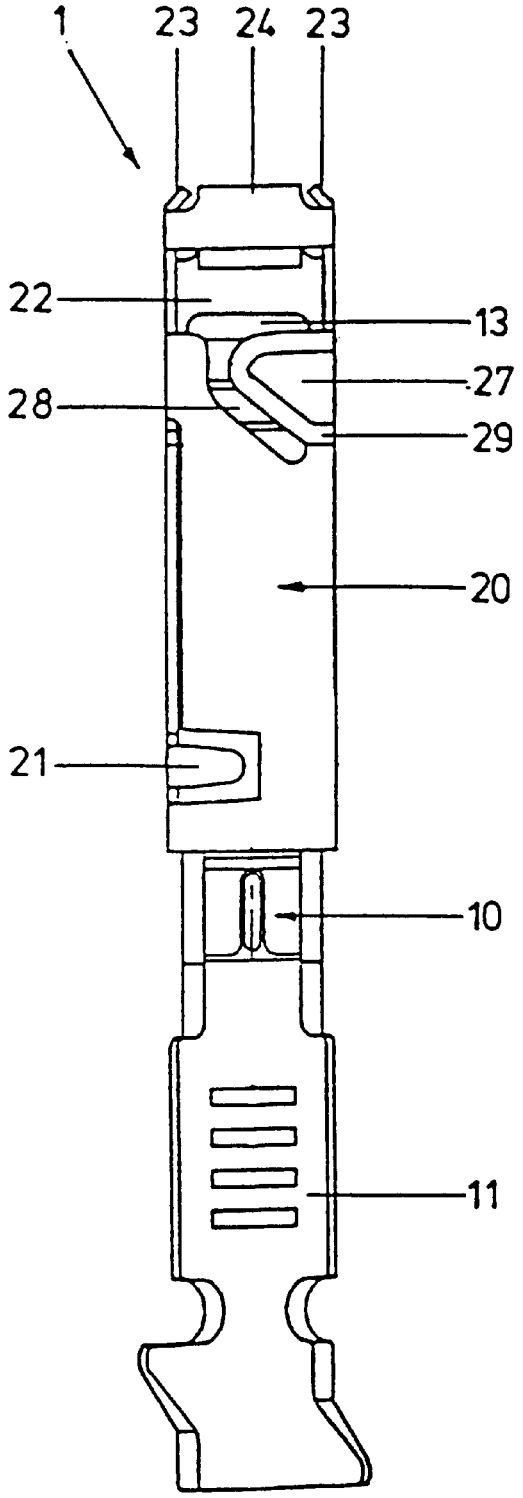
FIG. 1 plan view of the bottom wall of a crimp connection of a contact spring according to the invention with a crimp connection and a detent sleeve fitted over it.
Figure 2:
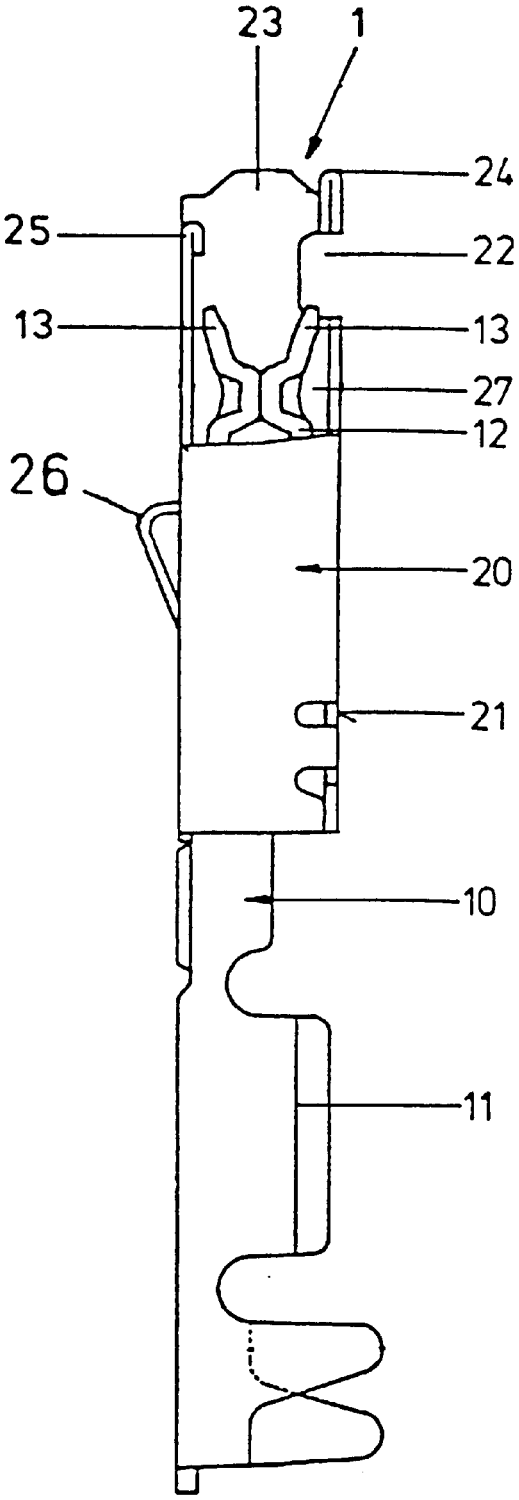
FIG. 2 is an elevational view of the contact spring of FIG. 1, rotated to the right by 90° about its longitudinal axis.

Referring now to the figures of the drawing in detail, in which identical reference numerals represent identical parts, and first, particularly, to FIGS. 1 and 2, there is seen an exemplary embodiment of a contact spring according to the invention. The contact spring is identified by reference numeral 1 and has a base spring 10, Such a base spring 10 is described in detail for instance in the earlier German patent applications P 196 11 698.8 and P 195 13 582.2, which are herewith incorporated by reference.

The base spring 10 has a connecting part 11 and a contact part 12. The connecting part, in the exemplary embodiment of FIGS. 1 and 2, is embodied as a so-called crimp connection with an insulation claw and a conductor wire claw, to which an electrical power line can be connected. Instead of a crimp connection, any other form of connecting part can also be chosen, such as a so-called IDC connector (insulation displacement connector) or the like. The contact part 12 of the base spring 10 is integrally connected to the connecting part 11. On the end toward the insertion side, the base spring 10 has at least two spring arms 13, which are provided as introduction funnels for a pin contact to be introduced between the two spring arms 13.

A boxlike detent sleeve 20 is clamped onto the base spring 10. The detent sleeve 20, which has four side walls clamped together via a clamping tab 21, extends past the spring arms 13 in the direction of the insertion side of the contact spring 1.

As can be seen from FIGS. 1 and 2, the detent sleeve 20 is provided, on its side toward the insertion side, with two opposed guard tabs 23, which are bent inward at an angle of approximately 45°. These two guard tabs 23 may additionally be provided with an embossed feature. Located between these two guard tabs 23 are two further guard tabs 24, 25, which are each bent backward by 180° on their ends. The guard tab 24, with its bent-over end, extends approximately as far as the distal ends of the guard tabs 23. Conversely, the guard tab 25, with its wall portion bent over by 180°, is disposed with its front end set back.

The detent sleeve 20 is formed with a void or a recess 22, which in the plan view of FIG. 1 has an approximately rectangular shape and in the exemplary embodiment shown extends over the entire broad side of the detent sleeve 20. The void 22 is located in the region of the detent sleeve 20 past which the spring arms 13 protrude in the direction of the insertion side of the contact spring 1. This void 22, together with detent elements of a surrounding housing, forms the primary securing means of the contact spring 1. This will be described in further detail below in conjunction with FIG. 3.

The detent sleeve 20 moreover has a so-called force boosting tab 27. With this force boosting tab 27, pressure is additionally exerted on the spring arms 13 of the base spring 10, on which the detent sleeve 20 is mounted. As can be seen, the force boosting tab 27 is approximately triangular in shape and is surrounded by a cutout 28. The force boosting tab 27 is preferably itself provided with a rounded or embossed feature 29, to prevent canting of the detent sleeve 20 when it is introduced into a surrounding housing of a plug connector.

As seen from the plan view of FIG. 2, the detent sleeve 20 has a polarizing tab 26, which is formed onto the inside of a side wall of the detent sleeve 20. This polarizing tab 26 is embodied without burrs both in the insertion direction and conversely to the insertion direction of the contact spring 1. This can be accomplished by using a suitable punch to push the force boosting tab 26 out of the sheet metal from which the detent sleeve 20 is stamped out. In the exemplary embodiment of FIG. 2, the polarizing tab 26 extends from the left side wall of the detent sleeve 20 upward by an angle of approximately 30 and then via a rounded bend extends back to the side wall forming approximately a right angle with it.

Figure 3:
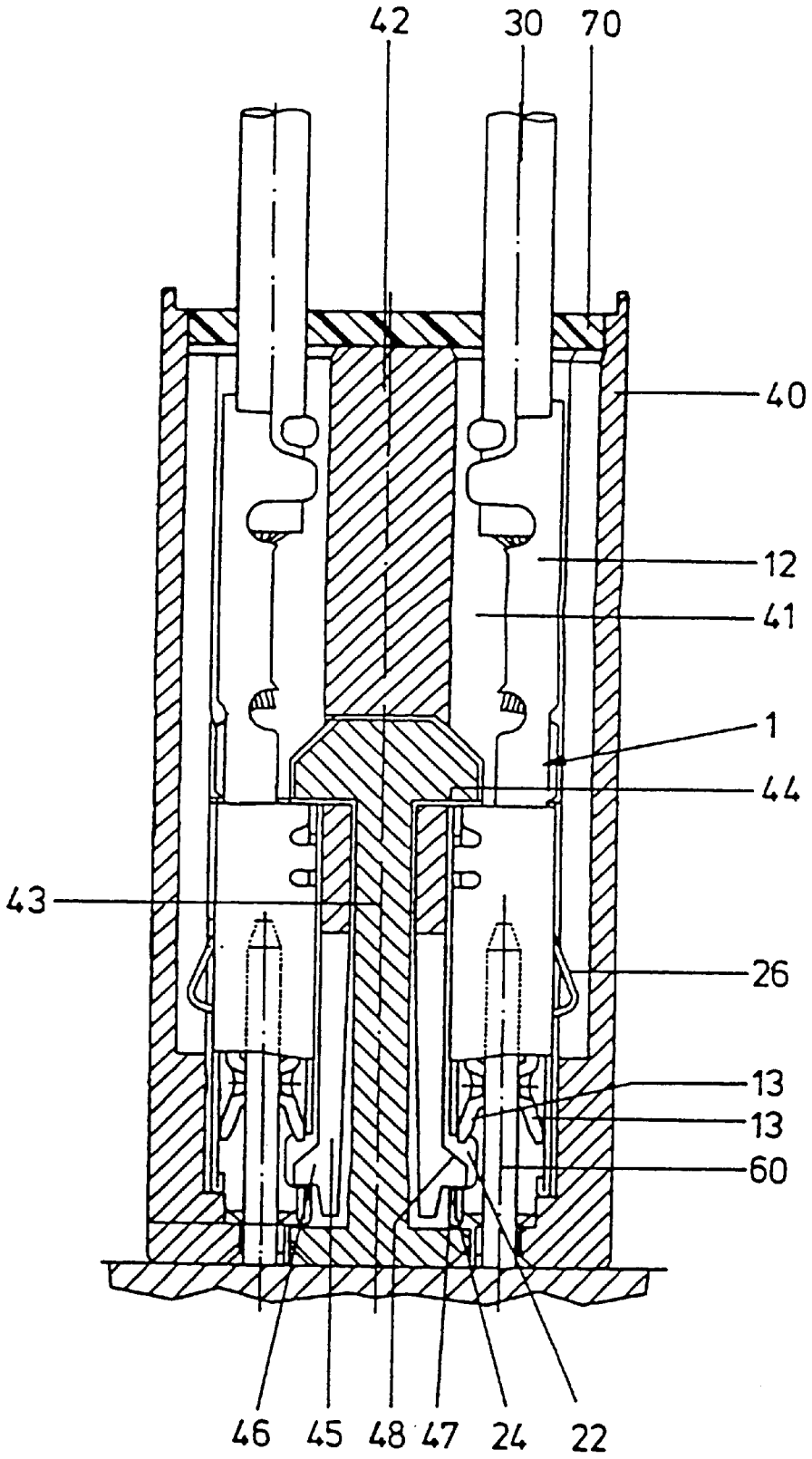
FIG. 3 is a longitudinal sectional view through a surrounding housing with a sealing plate and contact chambers, into which two contact springs of FIGS. 1 and 2 are inserted.

Referring now to the sectional view of FIG. 3, there is shown a surrounding housing 40 with two contact chambers 41, located side by side, into each of which there is inserted one of the contact springs 1 described above with reference to FIGS. 1 and 2. The two contact springs 1 are rotated by 180° relative to one another, with the two voids or recesses 22 pointing toward one another. One electrical power cord 30 is connected to each of the two contact springs 1. The electrical power cord 30 is clamped or soldered to the contact part 12 of the contact spring 1. The two contact springs 1 are properly inserted into the contact chambers 41 of the surrounding housing 40. The surrounding housing 40 is seated on a plate with contact pins 60, which are each inserted between the spring arms 13 of the base spring 10 and thus assure an electrical contact between the power cord 30 and the contact pins 60.

The two contact chambers 41 are separated from one another by a center partition 42 and a slide element 43 that is known per se. The slide element 43 is T-shaped in cross section and with edges 44 engages the detent sleeves 20 from behind in such a way as to assure a secondary locking of the contact springs 1. After the contact springs 1 have been inserted into the contact chambers 41, this slide element 43 is inserted in a direction orthogonal to the insertion direction of the contact spring, into the surrounding housing 40, in a direction orthogonal to the insertion direction of the contact spring, as a securing element.

For primary locking the surrounding housing 40 has one wall part 45 assigned to each contact chamber 41, and this wall part is provided on its end with a detent hook 46, which can engage the void 22 of the contact spring 1. The wall part 45 is embodied resiliently inside the surrounding housing 40. The detent hook 46, on its end toward the insertion side, has an edge 47 extending orthogonally to the insertion direction and an oblique edge 48 extending remote from the insertion direction. When the contact spring 1 is thrust into the contact chamber 41, the guard tab 24 presses the detent hook 46 backward by sliding along the oblique edge 48, and when the tip of the guard tab 25 strikes the face end of the contact chamber 41, this hook snaps resiliently into the void 22 of the detent sleeve 20. The resilient wall part 45 is integrally joined to the center partition 42.

As can also be seen from FIG. 3, the surrounding housing 40, on its distal end from the insertion side, has a sealing plate 70, which for example may be a rubber plate. The sealing plate 70 serves to seal off the plug connector and it is preferably formed with holes whose cross section is smaller than the cross section of a contact spring 1. On insertion of the contact springs into the surrounding housing 40, the contact springs 1 have to be pushed through these openings of the sealing plate 70. Since the contact spring 1, according to the invention, has no sharp edges, the contact spring 1 can be inserted through the sealing plate 70, into the contact chambers 41, without injuring it. Even for repair purposes, the contact springs can be pulled back out of the contact chambers 41 without risk to the sealing plate 70.

We claim:

1. A connector, comprising:

a housing formed with a chamber and a detent element in said chamber;

a contact spring having a base spring disposed in said housing, said base spring being formed with a connecting part for an electrical power cord at a first end thereof and with a contact part at a second end thereof, said contact part having at least two spring arms defining an insertion direction of the contact spring;

a detent sleeve seated on said base spring for retaining said base spring inside said housing; and said detent sleeve having a projecting portion projecting past said spring arms in the insertion direction, said projecting portion of said detent sleeve being formed with a void for receiving said detent element of said housing.

2. The connector according to claim 1, wherein said detent sleeve has a given width and said void extends over said given width.

3. The connector according to claim 1, wherein said detent sleeve is formed with guard tabs on a front end thereof toward the insertion direction, said guard tabs being bent obliquely inward.

4. The connector according to claim 1, wherein said detent sleeve is formed with guard tabs on a front end thereof toward the insertion direction, said guard tabs being bent backward by 180° opposite the insertion direction.

5. The connector according to claim 1, wherein said housing includes a resilient wall part carrying said detent element on an end thereof such that, when said base spring and said detent sleeve are inserted into said contact chamber of said housing, said detent element catches in said void of said detent sleeve.

6. The connector according to claim 1, wherein said housing includes a slide element formed with an edge which, when said base spring and said detent sleeve are properly inserted into said chamber of said housing, grips said detent sleeve from behind for secondarily locking said detent sleeve in said housing.

7. The connector according to claim 1, wherein said detent sleeve is box-shaped, and including a polarizing tab formed on an outer wall of said detent sleeve.

8. The connector according to claim 7, wherein the polarizing tab is formed without an edge in the insertion direction and opposite the insertion direction.

9. The connector according to claim 1, wherein said housing includes a sealing plate bounding said chamber, said base spring and said detent sleeve being passed through said sealing plate when the contact spring is assembled.

10. The connector according to claim 9, wherein said sealing plate is disposed at an end of said housing distally from an insertion side thereof, and a plane of said sealing plate being oriented substantially orthogonally relative to the insertion direction.

11. The connector according to claim 9, wherein said sealing plate is a rubber plate formed with openings, said openings having a diameter smaller than a cross section diameter of said detent sleeve.

* * * * *